US006510593B1

(12) United States Patent
Kim

(10) Patent No.: US 6,510,593 B1
(45) Date of Patent: Jan. 28, 2003

(54) LOCKABLE SLIDE FASTENER

(76) Inventor: Young S. Kim, 1612 Corlevia, Los Altos, CA (US) 94024

( * ) Notice: Subject to any disclaimer, the term of this patent is extended or adjusted under 35 U.S.C. 154(b) by 0 days.

(21) Appl. No.: 09/648,186

(22) Filed: Aug. 25, 2000

Related U.S. Application Data

(60) Provisional application No. 60/152,040, filed on Sep. 2, 1999.

(51) Int. Cl.[7] ..... E05B 67/38

(52) U.S. Cl. ..... 24/418; 24/382; 24/386; 24/419; 24/430; 70/68

(58) Field of Search ..... 24/386, 382, 385, 24/387–389, 415, 418, 429, 430, 205 R; 70/68, 66, 64, 67, 23, 69, 70, 13

(56) References Cited

U.S. PATENT DOCUMENTS

| | | | | | |
|---|---|---|---|---|---|
| 2,701,903 | A | * | 2/1955 | Williams | 24/205.15 |
| 4,081,882 | A | | 4/1978 | Toepelt et al. | 24/205 R |
| 4,123,829 | A | * | 11/1978 | Takabatake | 24/205 R |
| 4,244,086 | A | | 1/1981 | Gregg | 24/205.11 L |
| 4,350,375 | A | | 9/1982 | Bako | 292/24 |
| 4,395,891 | A | | 8/1983 | Remington | 70/68 |
| 4,512,599 | A | * | 4/1985 | De Lima Castro Netto | 292/307 R |
| 4,514,884 | A | * | 5/1985 | Kaneko | 24/386 |
| 4,884,419 | A | * | 12/1989 | Ling | 70/4 |
| 4,930,323 | A | * | 6/1990 | Terada et al. | 70/68 |
| 4,973,055 | A | * | 11/1990 | Muir | 273/29 |
| 4,976,120 | A | * | 12/1990 | Terada et al. | 70/68 |
| 5,063,760 | A | * | 11/1991 | Horita et al. | 70/23 |

* cited by examiner

*Primary Examiner*—J. J. Swann
*Assistant Examiner*—André L. Jackson
(74) *Attorney, Agent, or Firm*—Dorsey & Whitney LLP

(57) ABSTRACT

A slide fastener apparatus which includes a first and second slide with a releasable locking latch integral to the slides and a keyed, rotating cam as a locking mechanism.

6 Claims, 5 Drawing Sheets

LOCKABLE SLIDE FASTENER

RELATED APPLICATIONS

This application claims priority to Provisional Application No. 60/152,040, filed Sep. 2, 1999, incorporated by reference.

BRIEF DESCRIPTION OF THE INVENTION

This invention relates generally to slide fasteners or zippers, and more particularly to slide fasteners in which the slides can be locked to one another with a lock integral to the slide fastener.

BACKGROUND

1. Field of the Invention

Luggage, briefcases, backpacks, bags and the like, usually employ slide fasteners for closing their compartments. There are usually two slides which can be moved along the tracks. When they are moved into a butting relationship, the luggage, briefcase or the like is closed. The luggage or briefcase can be locked by inserting a lock through holes formed in the slide pulls. The slide pulls can incorporate mating links to provide a more effective point from which to secure a lock.

A lock is affixed through either the holes in the slide pulls or the mating links. Inserting a lock through the holes in the slide pulls is not always effective, however, especially if the item is loose and soft (i.e., a backpack or duffel bag). The matting links can prevent the slides from moving away from one another, however, locks are easily lost and may not be handy at a desirable time.

In view of the foregoing, it would be desirable to provide a slide mechanism with an integrated lock. This solution eliminates the need for a separate lock and prevents the slides from separating, even with loose and soft containers.

2. Description of the Prior Art

The prior art includes links with intersecting clasps, whereby a lock is inserted through the clasps and the links are held together by the lock. This art differs from the present invention because the lock in the prior art is separate from the links, whereas it is integral in the present invention.

SUMMARY OF THE INVENTION

It is a general object of the present invention to provide a slide fastener in which the slides can be locked to one another.

It is another object of the present invention to provide a slide fastener with parallel tracks which are locked to one another by two independently movable slides which include means for locking the slides to one another when they are brought into a butting relationship.

There is provided a slide fastener including a first and a second slides with slide surfaces. A releasable locking latch supported by the first slide, wherein the releasable locking latch comprises two opposing, hooked prongs, laterally mobile to one another. The releasable locking latch is contained within the first slide and protrudes out from the first slide and towards the second slide, and attaches with a crossed configuration to a pair of opposed handles in the first slide. The second slide includes a ledge that engages the locking latch to fasten and secure the first and second slide together, and a keyed, rotating shaft as a locking mechanism for the releasable locking latch.

BRIEF DESCRIPTION OF THE DRAWINGS

The foregoing and other objects of the invention will be more clearly understood by reading the accompanying description together with the drawings in which.

DESCRIPTION OF PREFERRED EMBODIMENT

Figure 1:
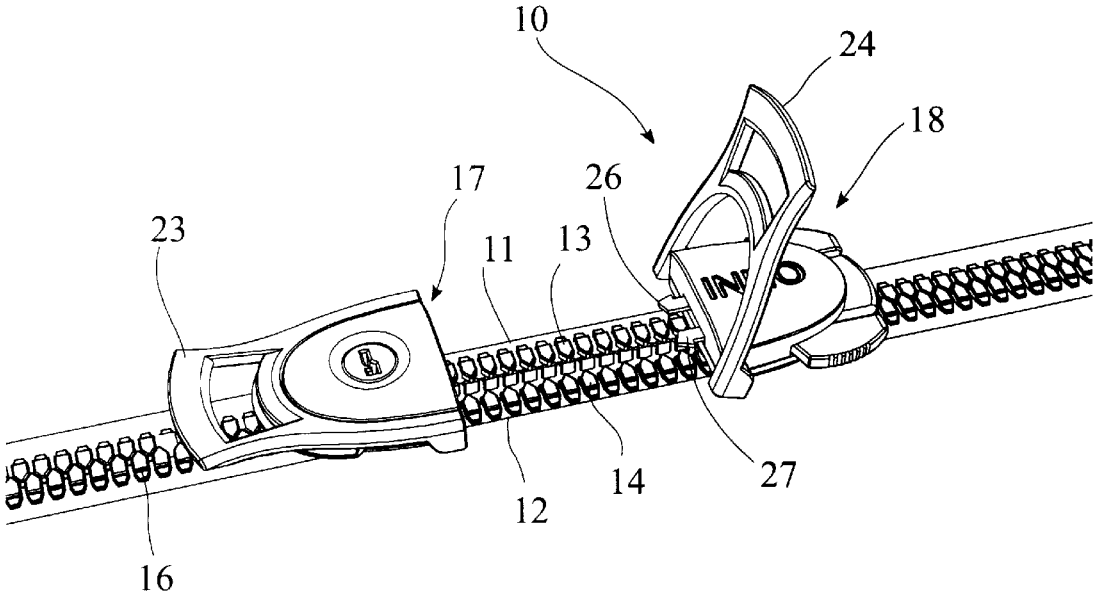
FIG. 1 is a perspective view of a slide fastener in accordance with the present invention.

FIG. 1 is a view of a slide fastener apparatus 10 in accordance with the present invention. The slide fastener 10 includes a female slide 17 and a male slide 18 which operate on a pair of tracks 11 and 12, with mating teeth 13 and 14. The tracks 11 and 12 are attached to a surface such as nylon, leather, canvas, etc., typically with stitching (not shown). The mating teeth 13 and 14 engage one another to join the tracks 11 and 12 to one another as shown at 16. The teeth 13 and 14 are locked to one another by moving the female and male slides 17 and 18 towards one another along the tracks 11 and 12, whereby to urge the teeth 13 and 14 into interlocking relationship, as a result of camming by the slide surfaces 21 and 22, shown in FIG. 4. The female and male slides 17 and 18 include pulls 23 and 24, respectively, which can be grasped by the user to move the female and male slides 17 and 18 along the tracks 11 and 12. The pulls 23 and 24 are rotatably attached to the female and male slides 17 and 18, and are able to rotate through a 180° arc.

Figure 4:
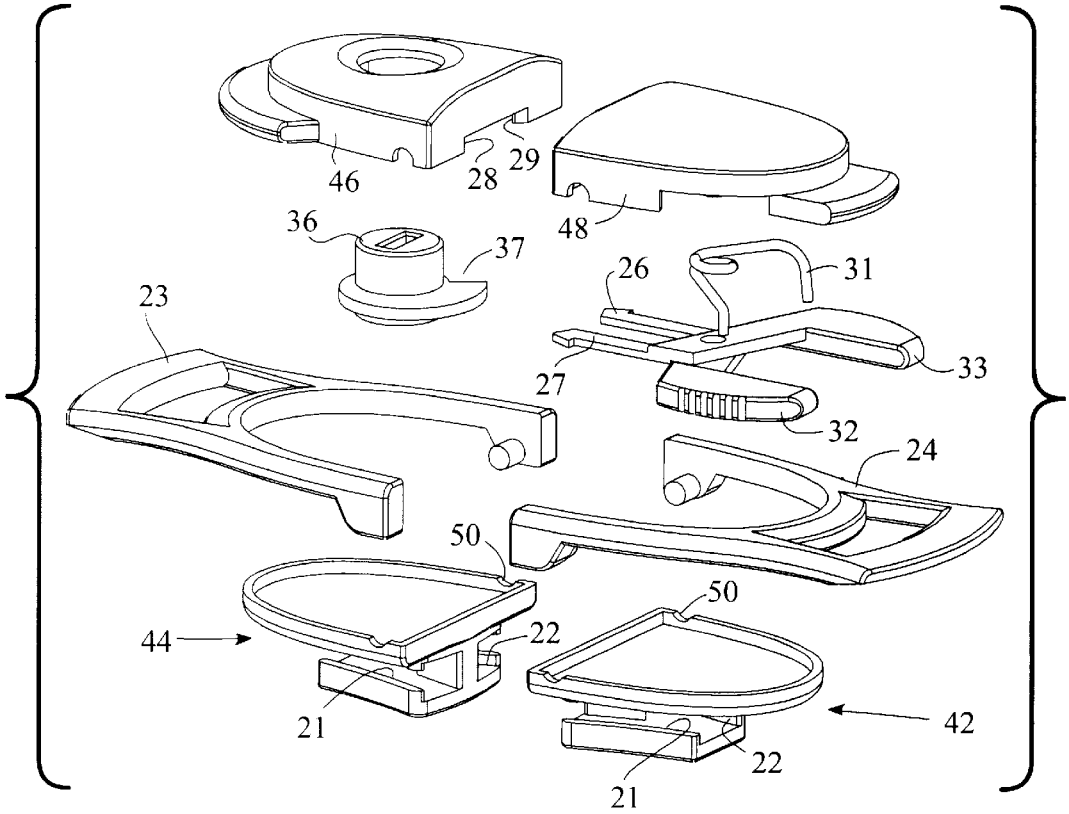
FIG. 4 is an exploded view of the cooperating slide fasteners showing the parts.

The male slide 18 includes protruding, spring-loaded, latching members 26 and 27 which enter a pair of spaced ledges 28 and 29 at the end of the female slide 17, shown in FIG. 4. The latching members 26 and 27 are operated through the compression of handles 32 and 33. Compression of the handles 32 and 33 cause the latching members 26 and 27 to move towards one another and allows the female and male slides 17 and 18 to separate. The keyhole 38 provides a slot for the insertion of a key (not shown) to lock or unlock the latching members 26 and 27.

Figure 2:
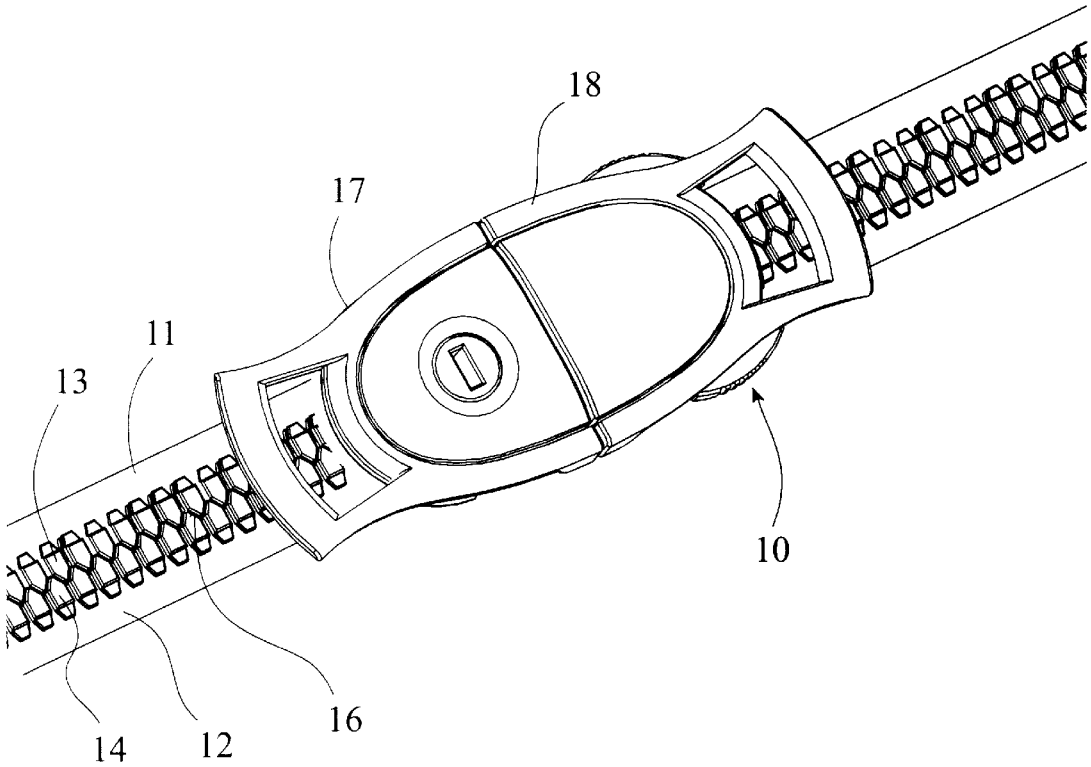
FIG. 2 is a perspective view of the slide fastener of FIG. 1, with the slides locked to one another.

FIG. 2 shows a top view of a slide fastener apparatus 10 in accordance with the present invention. The mating teeth 13 and 14 on the tracks 11 and 12 are linked 5 together, shown at 16. The female and male slides 17 and 18 are linked with the latching members 26 and 27 actively engaged and maintaining the connection.

Figure 3:
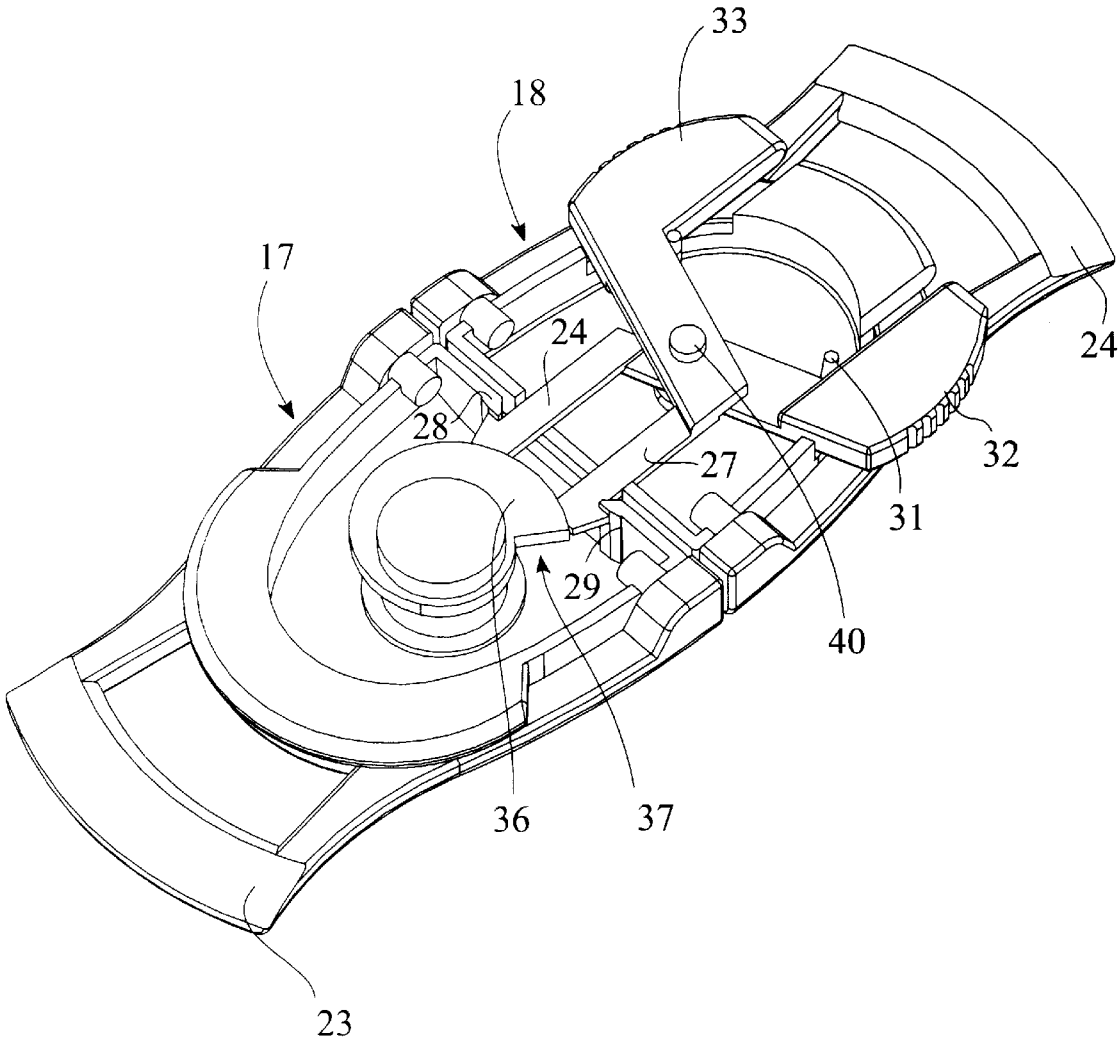
FIG. 3 is a perspective view of the internal operating mechanism for locking the slides to one another.

FIG. 3 is a perspective view of the slide fastener apparatus 10 showing the latching members 26 and 27 actively engaging the female slide 17. In order to close the slide fastener 10, the female and male slides 17 and 18 are pushed together and the 10 latching members 26 and 27 engage the spaced ledges 28 and 29 on the female slide 17.

In order to release the female and male slides 17 and 18, the handles 32 and 33 are compressed together forcing the latching members 26 and 27 to rotate about the pivot point 40 and move toward one another. A spring 31 coiled about the pivot point 40 maintains the latching members 26 and 27 as well as the handles 32 and 33 in an open position.

A rotatable locking cam 36 is provided which engages the ends of the latching members 26 and 27 and locks them into position preventing any movement until the locking cam 36 is rotated to bring the area 37 opposite the latching members 26, whereby they can be moved. The locking cam 36 can be keyed to securely lock the female and male slides 17 and 18 into place.

FIG. 4 shows a an exploded view of the slide fastener apparatus 10. The female and male slides 17 and 18 have base components 44 and 42 with slide surfaces 21 and 22.

The slide surfaces 21 and 22 engage the mating teeth 13 and 14. The female and male housings 46 and 48 form the top of the female and male slides 17 and 18. Underneath the male housing 48 is the coiled spring 31, the handles 32 and 33 with the latching members 26 and 27, and the pull 24 for the male slide 18. The pivot point 40 is either attached to the male housing 48 or formed with it, but cannot be seen in this view. The pivot point 40 is a cylindrical rod over which the coiled spring 31 and the latching members 26 and 27 rest.

The female housing 46 contains the pair of spaced ledges 28 and 29. Underneath the female housing 46 is the locking cam 36, which is contained by brackets (not shown) within the female housing 46.

The pulls 23 and 24 fit into a groove 50 formed by the housings 46 and 48 and the base components 44 and 42. The housings 46 and 48 and the base components 44 and 42 can be attached to one another by glue, clips, attachment points, or any means known in the art.

Figure 5:
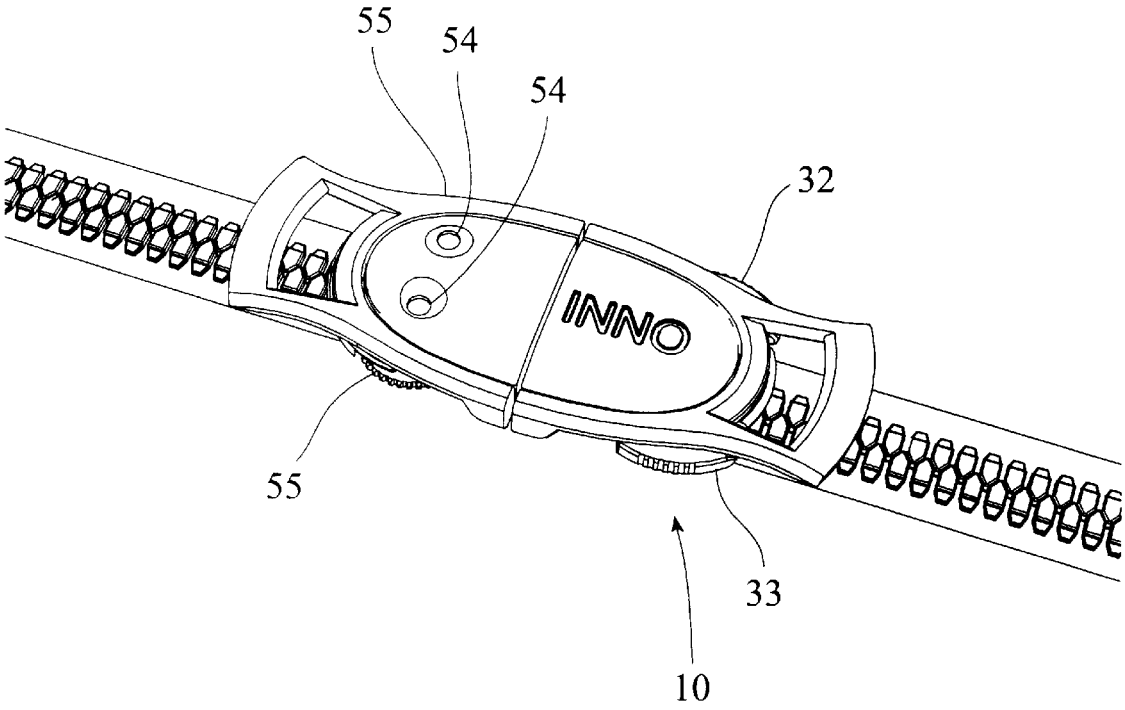
FIG. 5 is a perspective view of a combination lock in a slide fastener in accordance with the present invention.

FIG. 5 shows an embodiment where a combination lock replaces the keyed lock. A dial 55 on each side of slide fastener apparatus 10 rotates to show different numbers in a display hole 54. When the numbers reflect the correct position for the dials 55 then pressure on handles 32 and 33 release latching members 26 and 27.

The foregoing description, for purposes of explanation, used scientific nomenclature to provide a thorough understanding of the invention. However, it will be apparent to one skilled in the art that the specific details are not required in order to practice the invention. The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled the art to best utilize the invention and various embodiments with various modifications as are suited to the particular use contemplated. It is intended that the scope of the invention be defined by the following claims and their equivalents.

What is claimed is:

1. A slide fastener including:

a first and a second slide with slide surfaces, and a releasable locking latch supported by the first slide, wherein said releasable locking latch comprises two opposing, laterally mobile, hooked prongs attached with a crossed configuration to a pair of opposed handles, said second slide comprises a pair of spaced ledges that engage the opposing hooked prongs to fasten and secure the first and second slide together, and the two opposing hooked prongs slide into and out of said second slide by compressing the oposed handles.

2. The slide fastener of claim 1 wherein said second slide further comprises a locking mechanism for the releasable locking latch.

3. The slide fastener of claim 2 wherein said locking mechanism is a keyed rotating cam.

4. The slide fastener of claim 2 wherein said locking mechanism is a rotating dial.

5. A slide fastener including a first and a second slide with slide surfaces, a releasable locking latch supported by the first slide, wherein the releasable locking latch comprises two opposing, hooked prongs, laterally mobile to one another, and are contained within the first slide and protrude out from the first slide and towards the second slide, and attached with a crossed configuration to a pair of opposed handles in the first slide, the second slide includes a pair of spaced ledges that engage the opposing, hooked prongs to fasten and secure the first and second slides together, and a keyed, rotating cam as a locking mechanism for the releasable locking latch.

6. A slide fastener including a first and a second slide with slide surfaces, a releasable locking latch supported by the first slide, wherein the releasable locking latch comprises two opposing, hooked prongs, laterally mobile to one another, and are contained within the first slide and protrude out from the first slide and towards the second slide, and attached with a crossed configuration to a pair of opposed handles in the first slide, the second slide includes a pair of spaced ledges that engage the opposing, hooked prongs to fasten and secure the first and second slides together, and at least one rotating dial as a locking mechanism for the releasable locking latch.

* * * * *